US009479878B2

(12) United States Patent
Higgins et al.

(10) Patent No.: US 9,479,878 B2
(45) Date of Patent: Oct. 25, 2016

(54) ENHANCED COMFORT EARBUD

(71) Applicant: Starkey Laboratories, Inc., Eden Prairie, MN (US)

(72) Inventors: Sidney A. Higgins, Maple Grove, MN (US); Timothy Daniel Trine, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 14/467,392

(22) Filed: Aug. 25, 2014

(65) Prior Publication Data

US 2016/0057551 A1 Feb. 25, 2016

(51) Int. Cl.

| | |
|---|---|
| ***H04R 25/00*** | (2006.01) |
| ***H04R 1/10*** | (2006.01) |
| ***H04R 31/00*** | (2006.01) |

(52) U.S. Cl.

CPC ..... *H04R 25/60* (2013.01); *H04R 1/1091* (2013.01); *H04R 25/652* (2013.01); *H04R 25/656* (2013.01); *H04R 31/00* (2013.01); *H04R 1/1016* (2013.01); *H04R 25/65* (2013.01); *H04R 25/654* (2013.01); *H04R 2460/09* (2013.01); *H04R 2460/11* (2013.01)

(58) Field of Classification Search

CPC .... H04R 1/10; H04R 1/1008; H04R 1/1016; H04R 1/105; H04R 1/1058; H04R 1/1066; H04R 1/1075; H04R 5/033; H04R 5/027; H04R 5/0335; H04R 2205/024; H04R 2201/103; H04R 2205/022; H04R 2420/07; H04R 25/654; H04R 25/652; H04R 2460/09; H04R 2460/11; H04R 25/60; H04R 1/1091; H04R 25/656; H04R 25/65

USPC ..... 381/358, 367, 370, 371, 374, 375, 380; 181/129, 130, 133, 135, 136; 264/295

See application file for complete search history.

(56) References Cited

U.S. PATENT DOCUMENTS

| | | | | |
|---|---|---|---|---|
| 2,803,308 | A * | 8/1957 | Di Mattia | A61B 7/02 181/135 |
| 4,457,396 | A | 7/1984 | James | |
| 5,242,767 | A * | 9/1993 | Roback | H01M 2/1022 320/114 |
| 5,781,638 | A | 7/1998 | Hosaka et al. | |
| 6,000,492 | A * | 12/1999 | Puthuff | H04R 25/654 181/135 |
| 7,010,137 | B1 * | 3/2006 | Leedom | A61B 5/6817 381/322 |
| 8,061,472 | B2 | 11/2011 | Tiemens | |
| 2006/0280325 | A1 | 12/2006 | Lin et al. | |
| 2007/0221232 | A1 * | 9/2007 | Jenkins | A61F 11/08 128/864 |
| 2009/0052711 | A1 | 2/2009 | Murozaki | |
| 2009/0101433 | A1 * | 4/2009 | Stiehl | B29C 45/0025 181/129 |
| 2010/0300461 | A1 | 12/2010 | Gilder et al. | |
| 2016/0057528 | A1 | 2/2016 | Trine et al. | |

OTHER PUBLICATIONS

U.S. Appl. No. 14/467,353, Non Final Office Action mailed Dec. 10, 2015, 21 pgs.

U.S. Appl. No. 14/467,353, Response filed Apr. 11, 2016 to Non Final Office Action mailed Dec. 10, 2015, 10 pgs.

European Application Serial No. 15182269.9, Extended European Search Report mailed Jan. 12, 2016, 8 pgs.

* cited by examiner

*Primary Examiner* — Davetta W Goins
*Assistant Examiner* — Oyesola C Ojo
(74) *Attorney, Agent, or Firm* — Schwegman Lundberg & Woessner, P.A.

(57) ABSTRACT

An earbud that uniformly conforms to the ear canal and maintains a constant and comfortable radial pressure on the ear canal regardless of size. The earbud is designed to extrude distally when placed inside a small canal and yet still conforms to the canal while maintaining the aforementioned comfortable radial pressure. A wax bridge may be added to provide an added layer of wax protection to the earbud.

19 Claims, 2 Drawing Sheets

ENHANCED COMFORT EARBUD

FIELD OF THE INVENTION

This invention pertains to electronic hearing aids and methods for their construction.

BACKGROUND

Hearing aids are electroacoustic device which amplify sound for the wearer in order to correct hearing deficits as measured by audiometry, usually with the primary purpose of making speech more intelligible. Certain types of hearing aids utilize an earbud that is placed in the wearer's external ear canal that conducts the sound produced by the hearing aid's receiver (i.e., loudspeaker). A receiver-in-canal (RIC) hearing aid has a small body that sits behind the ear and houses the hearing aid's microphone and audio processing circuitry. The receiver of the RIC hearing aid is attached to the earbud inside the ear and is connected to the body of the hearing aid by a slim tube that houses the receiver wiring. Other types of hearing aids may incorporate the receiver into the body behind the ear which then conducts sound to an earbud inside the ear via an audio tube. Most hearing aids that utilize earbuds, however, are uncomfortable to wear over extended periods due to the physical design of the earbuds and varying external ear canal geometry.

DETAILED DESCRIPTION

Most earbuds for RIC hearing aids feature one or more thin circular flanges to center and hold a receiver or tube assembly in the ear canal. Generally this flange in cross-section has a constant or tapering wall thickness terminating near the aft of the bud at or near its apex (maximum diameter). Due to the physical variations in shape and size of individual ear canals a precise fit with uniform pressure is difficult to attain with this design. When a precise fit is not made, the earbud flange will distort and wrinkle resulting in increased pressure points that ultimately cause soreness and dissatisfaction.

Described herein is an earbud (made of silicone or other material) that uniformly conforms to the ear canal and maintains a constant and comfortable radial pressure on the ear canal regardless of size. The earbud is designed to extrude distally when placed inside a small canal and yet still conforms to the canal while maintaining the aforementioned comfortable radial pressure. A wax bridge may be added to help prevent ear wax from entering the earbud and reaching the attached receiver.

Figure 1A:
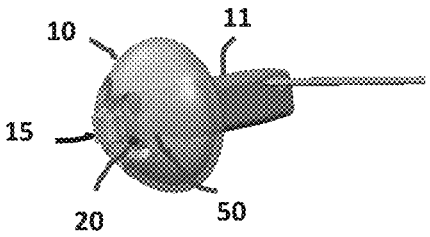
FIGS. 1A and 1B show embodiments of an earbud attached to a hearing aid receiver component.
Figure 1B:
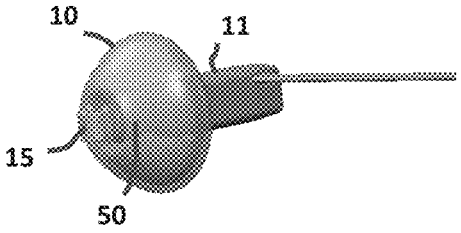
Figure 2:
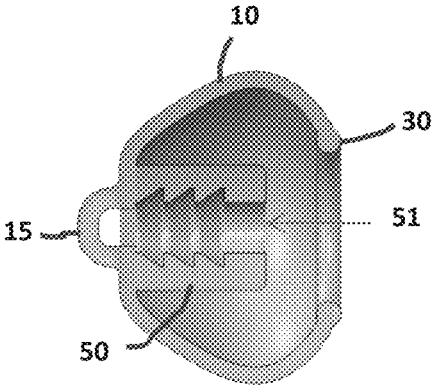
FIG. 2 shows an embodiment of an earbud in cross-section.

FIGS. 1A and 1B show example embodiments of an earbud each of which includes a body 50 and a flange 10. The earbud in each of the embodiments is shown as attached to a receiver component 11 of a hearing aid. FIG. 2 shows the earbud in cross-section. The body 50 is a cylindrically shaped having proximal end with a wax bridge 15 that is inserted into the ear canal and a distal end having a cavity 51 for receiving and connecting to a hearing aid's receiver or audio tube. The cavity 51 also provides an acoustic port covered by the wax bridge 15 at the proximal end of the body 50 for conducting sound produced by the hearing aid receiver into the external ear canal. The wax bridge 15 prevents direct line of sight wax ingress into the attached receiver component 11. The flange 10 extends radially and distally from the circumference of the proximal end of the body 50 and terminates in a relatively more rigid retainer ring 30. The flange 10 and retainer ring 30 may be made of a resilient material such as silicone with the cross-sectional thickness of the retaining ring greater than the cross-sectional thickness of the flange. The circumference of the flange 10 increases with longitudinal distance from the proximal end of the body up to a maximum value at an apex and then decreases to the circumference of the retainer ring 30.

In one embodiment, as shown in the figures, the longitudinal distance from the apex of the flange 10 to the retainer ring 30 is shorter than the longitudinal distance from the apex of the flange 10 to the proximal end of the body 50. Also, the rate at which the circumference of the flange 10 decreases with respect to longitudinal distance from the apex of the flange to the retainer ring 30 may be made greater than the rate at which the circumference of the flange 10 increases with respect to longitudinal distance from the proximal end of the body 50 to the apex of the flange.

The extension of the flange 10 past its apex thus creates a balloon effect, and the retainer ring 30 prevents warping and puckering when the flange is deflected to maintain a circular or oval cross-section. Over time, areas of puckering in an earbud may create sore spots in the ear canal which reduce comfort. Excess radial pressure causes the flange 10 to extrude distally along the attached receiver component 11 while maintaining a radial seal against the external ear canal. The flange 10 tends to return to its molded shape die to the flange and retainer ring combination. The embodiment shown in FIG. 1A is an open design and has one or more openings 20 in the flange 10 adjacent to the proximal end of the body 50. The embodiment shown in FIG. 1B is an occluded design where the flange extends continuously from the circumference of the proximal end of the body 50.

In one embodiment, the earbud as described above is constructed from a single-shot molding process where the material thicknesses of the body, flange, and/or retainer ring are made different so as to result in different degrees of resilience or stiffness between those components. In another embodiment, a two-shot or multiple shot molding process may be used so that the body is made of a stiffer material than the flange. Using a stiffer material for the body, for example, allows it to be constructed with a thinner wall section.

Figure 3:
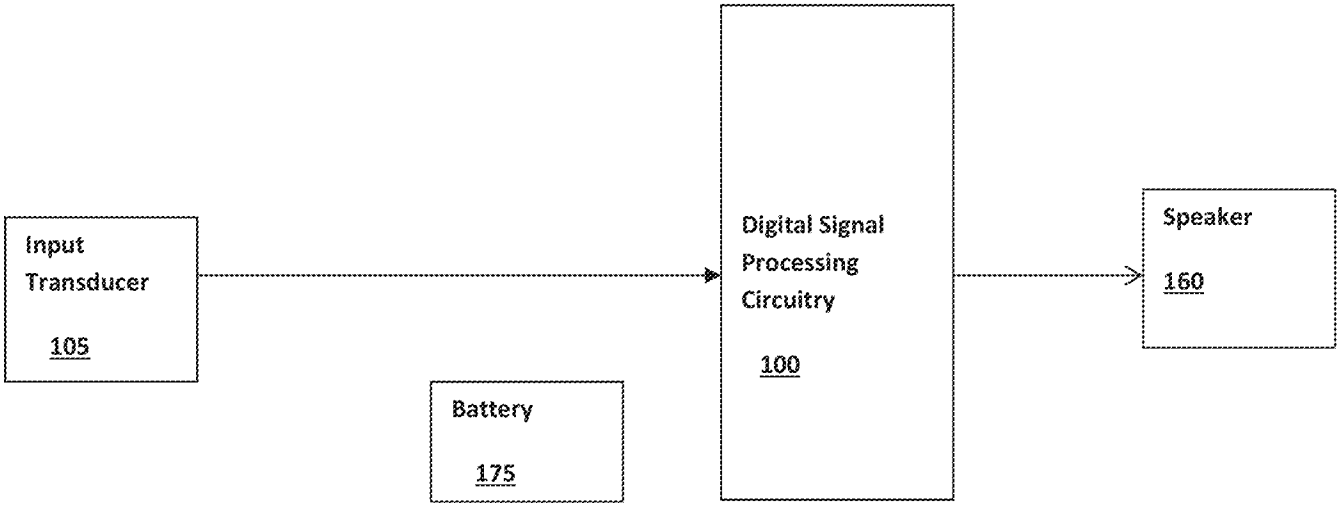
FIG. 3 shows the basic electronic components of an example hearing aid.

FIG. 3 illustrates the basic functional components of an example hearing aid. Hearing aids are devices that compensate for hearing losses by amplifying sound whose electronic components include a microphone for receiving ambient sound, an amplifier for amplifying the microphone signal in a manner that depends upon the frequency and amplitude of the microphone signal, a speaker for converting the amplified microphone signal to sound for the wearer, and a battery for powering the components. The electronic circuitry of the hearing aid is contained within a housing that may be placed, for example, in the external ear canal or behind the ear. An input transducer (i.e., microphone) 105 receives sound waves from the environment and converts the sound into an input signal. After amplification by a pre-amplifier, the input signal is sampled and digitized to result in a digitized input signal that is passed to digital signal processing (DSP)

circuitry 100. The DSP circuitry processes the digitized input signal into an output signal in a manner that compensates for the patient's hearing deficit (e.g., frequency-specific amplification and compression). The output signal is then converted to analog form and passed to an audio amplifier that drives a receiver 160 (a.k.a. a loudspeaker) to convert the output signal into an audio output. A battery 175 supplies power for the electronic components. In an RIC hearing aid, the receiver 160 may be attached to an earbud such as described above that is placed in the external ear canal, while the rest of the hearing aid components are housed in a main body that is usually placed behind ear. In other types of hearing aids, the receiver 160 may be housed in the main body with sound conducted to the earbud via an audio tube.

Example Embodiments

In an example embodiment, a hearing aid comprises: an input transducer for converting an audio input into an input signal; a digital signal processor (DSP) for processing the input signal into an output signal in a manner that compensates for a patient's hearing deficit; an audio amplifier and receiver for converting the output signal into an audio output; and an earbud as described above attached to the receiver.

Hearing assistance devices typically include an enclosure or housing, a microphone, hearing assistance device electronics including processing electronics, and a speaker or receiver. It is understood that in various embodiments the microphone is optional. It is understood that in various embodiments the receiver is optional. Such devices may include antenna configurations, which may vary and may be included within an enclosure for the electronics or be external to an enclosure for the electronics. Thus, the examples set forth herein are intended to be demonstrative and not a limiting or exhaustive depiction of variations.

It is further understood that any hearing assistance device may be used without departing from the scope and the devices depicted in the figures are intended to demonstrate the subject matter, but not in a limited, exhaustive, or exclusive sense. It is also understood that the present subject matter can be used with a device designed for use in the right ear or the left ear or both ears of the wearer.

It is understood that digital hearing aids include a processor. In digital hearing aids with a processor programmed to provide corrections to hearing impairments, programmable gains are employed to tailor the hearing aid output to a wearer's particular hearing impairment. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, and certain types of filtering and processing. In various embodiments the processor is adapted to perform instructions stored in memory which may or may not be explicitly shown. Various types of memory may be used, including volatile and nonvolatile forms of memory. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. An earbud for insertion into an external ear canal, comprising:

a cylindrically shaped body having proximal and distal ends and having a cavity located at its distal end for receiving and connecting to a hearing aid's receiver or audio tube;

a flange made of resilient material extending radially and distally from the circumference of the proximal end of the body and terminating in a relatively more rigid retainer ring, wherein the circumference of the flange increases with longitudinal distance from the proximal end of the body up to a maximum value at an apex and then decreases to the circumference of the retainer ring;

wherein the longitudinal distance from the apex of the flange to the retainer ring is shorter than the longitudinal distance from the apex of the flange to the proximal end of the body and further wherein the rate at which the circumference of the flange decreases with respect to longitudinal distance from the apex of the flange to the retainer ring is greater than the rate at which the circumference of the flange increases with respect to longitudinal distance from the proximal end of the body to the apex of the flange; and, an acoustic port located at the proximal end of the body for conducting sound produced by the hearing aid receiver into the external ear canal.

2. The earbud of claim 1 wherein the cross-sectional thickness of the retaining ring greater than the cross-sectional thickness of the flange.

3. The earbud of claim 1 wherein the circumference of the retaining ring is greater than the circumference of the body.

4. The earbud of claim 1 further comprising a bridge covering the acoustic port to prevent direct line-of-sight wax ingress into the acoustic port.

5. The earbud of claim 1 wherein the flange has one or more openings adjacent to the body.

6. The earbud of claim 1 wherein the flange extends distally such that the retainer ring is distal to the distal end of the body.

7. A method for constructing an earbud for insertion into an external ear canal, comprising:

molding a cylindrically shaped body with proximal and distal ends and having a flange made of resilient material extending radially and distally from the circumference of the proximal end of the body and terminating in a relatively more rigid retainer ring, wherein the circumference of the flange increases with longitudinal distance from the proximal end of the body up to a maximum value and then decreases to the circumference of the retainer ring;

wherein the longitudinal distance from the apex of the flange to the retainer ring is shorter than the longitudinal distance from the apex of the flange to the proximal end of the body and further wherein the rate at which the circumference of the flange decreases with respect to longitudinal distance from the apex of the flange to the retainer ring is greater than the rate at which the circumference of the flange increases with respect to longitudinal distance from the proximal end of the body to the apex of the flange;

disposing a cavity located at the distal end of the body for receiving and connecting to a hearing aid's receiver or audio tube; and, disposing an acoustic port at the proximal end of the body for conducting sound produced by the hearing aid receiver into the external ear canal.

8. The method of claim 7 wherein the cross-sectional thickness of the retaining ring greater than the cross-sectional thickness of the flange.

9. The method of claim 7 wherein the circumference of the retaining ring is greater than the circumference of the body.

10. The method of claim 7 further comprising forming a bridge covering the acoustic port to prevent direct line-of-sight wax ingress into the acoustic port.

11. The method of claim 7 further comprising forming one or more openings in the flange adjacent to the body.

12. The method of claim 7 wherein the flange extends distally such that the retainer ring is distal to the distal end of the body.

13. The method of claim 7 wherein the molding is carried out using a single-shot molding process.

14. The method of claim 7 wherein the molding is carried out using a double-shot molding process with the flange and body made of different materials.

15. A hearing aid, comprising:

an input transducer for converting an audio input into an input signal;

a digital signal processor (DSP) for processing the input signal into an output signal in a manner that compensates for a patient's hearing deficit;

an audio amplifier and speaker for converting the output signal into an audio output;

an earbud for insertion into an external ear canal that includes: a cylindrically shaped body having proximal and distal ends and having a cavity located at its distal end for receiving and connecting to a hearing aid's receiver or audio tube, a flange made of resilient material extending radially and distally from the circumference of the proximal end of the body and terminating in a relatively more rigid retainer ring wherein the circumference of the flange increases with longitudinal distance from the proximal end of the body up to a maximum value and then decreases to the circumference of the retainer ring, and an acoustic port located at the proximal end of the body for conducting sound produced by the hearing aid receiver into the external ear canal; and, wherein the longitudinal distance from the apex of the flange to the retainer ring is shorter than the longitudinal distance from the apex of the flange to the proximal end of the body and further wherein the rate at which the circumference of the flange decreases with respect to longitudinal distance from the apex of the flange to the retainer ring is greater than the rate at which the circumference of the flange increases with respect to longitudinal distance from the proximal end of the body to the apex of the flange.

16. The hearing aid of claim 15 wherein the cross-sectional thickness of the retaining ring greater than the cross-sectional thickness of the flange.

17. The hearing aid of claim 15 wherein the circumference of the retaining ring is greater than the circumference of the body.

18. The hearing aid of claim 15 further comprising a bridge covering the acoustic port to prevent direct line-of-sight wax ingress into the acoustic port.

19. The hearing aid of claim 15 wherein the flange has one or more openings adjacent to the body.

* * * * *